US007131465B1

(12) United States Patent
Chapman

(10) Patent No.: US 7,131,465 B1
(45) Date of Patent: Nov. 7, 2006

(54) REMOVABLE PLASTIC HEDDLE WITH MATING INSERTION TOOL FOR WEAVING APPARATUS

(76) Inventor: Arthur S. Chapman, P.O. Box 819, Solvang, CA (US) 93464

( * ) Notice: Subject to any disclaimer, the term of this patent is extended or adjusted under 35 U.S.C. 154(b) by 7 days.

(21) Appl. No.: 11/159,048

(22) Filed: Jun. 21, 2005

Related U.S. Application Data

(60) Provisional application No. 60/583,255, filed on Jun. 24, 2004.

(51) Int. Cl.
*D03J 1/14* (2006.01)
*D03C 9/02* (2006.01)
*D03C 9/00* (2006.01)

(52) U.S. Cl. ..... 139/93; 139/51; 139/52; 139/53; 139/380

(58) Field of Classification Search ..... 139/51, 139/52, 53, 93, 94, 96, 380
See application file for complete search history.

(56) References Cited

U.S. PATENT DOCUMENTS 1,594,542 A * 8/1926 Manley ..... 139/48
1,644,573 A * 10/1927 Fish ..... 139/52
2,019,822 A * 11/1935 Kaufmann ..... 139/94
2,249,390 A * 7/1941 Mahler ..... 139/93
2,552,487 A * 5/1951 Kaufmann ..... 139/96
3,322,159 A * 5/1967 Kaufmann ..... 139/96
3,349,811 A * 10/1967 Kaufmann ..... 139/96
4,155,379 A * 5/1979 Graf ..... 139/93
4,334,555 A 6/1982 Hoagland
4,703,777 A 11/1987 Saint-Hilaire
4,790,357 A 12/1988 Kramer
4,967,802 A * 11/1990 Klocker ..... 139/51
5,005,608 A 4/1991 Anderson
5,040,571 A * 8/1991 Klocker et al. ..... 139/52
5,078,183 A * 1/1992 Broughton ..... 139/52
5,152,325 A * 10/1992 Koch ..... 139/91
5,191,917 A * 3/1993 Krumm et al. ..... 139/380
5,348,055 A * 9/1994 Kramer ..... 139/93
5,474,110 A * 12/1995 Mettler ..... 139/93
5,699,836 A * 12/1997 Golz ..... 139/22
6,116,291 A * 9/2000 Hockemeyer et al. ..... 139/51
6,213,162 B1 * 4/2001 Baechtold ..... 139/93
6,883,554 B1 * 4/2005 Baumann et al. ..... 139/93
6,901,970 B1 * 6/2005 Kikuchi ..... 139/93

* cited by examiner

*Primary Examiner*—Gary L. Welch
*Assistant Examiner*—Robert H Muromoto, Jr.

(57) ABSTRACT

A simple removable plastic heddle comprised of a single monolithic plastic body and a mating insertion tool.

3 Claims, 4 Drawing Sheets

REMOVABLE PLASTIC HEDDLE WITH MATING INSERTION TOOL FOR WEAVING APPARATUS

CROSS-REFERENCE TO RELATED APPLICATIONS

This application claims the benefit of provisional patent application Ser. No. 60/583,255, filed 2004 Jun. 24 by the present inventor.

FEDERALLY SPONSORED RESEARCH

None

SEQUENCE LISTING

None

BACKGROUND OF THE INVENTION

This invention relates to weaving heddles for looms; specifically to removable weaving heddles and a corresponding insertion tool to aid installation of the heddle in a shaft assembly of a weaving loom: a single insertion tool serving to install many loom heddles.

The current trend in heddle design requires the warp to be inserted through the eye of each and every heddle and then through the individual reed elements before the tensioning of each warp element can be implemented. If a mistake is made in this initial process the entire warping sequence is subject to re-threading which is a time consuming process. The average 30" weaving width loom will have as many as 450 heddles to sequence without making a single mistake. This process is one of the fundamental impediments to attracting new weavers to the hobby of weaving.

The removable plastic heddle solves part of the problem of having to re-thread the entire warp by allowing a heddle to be transferred from one movable shaft to a different shaft or eliminating the heddle entirely. The removal and installation of the heddle must be a simple process that is not, in itself, time consuming.

A further advantage of the removable heddle is the potential for switching shafts during the weaving process which allows changing patterns in adjacent weaving increments. This has the potential of making small looms with limited shafts appear to function as though they had extra shafts. This process can be done without disturbing the sequential warp placement in the reed.

PRIOR ART

There have been prior patents addressing the issue of removable heddles but none appear to be able to simulate the simplicity and ease of manufacture of the device being presented in this application.

U.S. Pat. No. 4,703,777 to Sait-Hilaire (Nov. 3, 1987) Illustrates a lateral threading wire heddle where the warp can be removed but the heddle remains in place. The wire heddle is easily deformed over time and when it is deformed the tendency to snag on adjacent warp elements is increased dramatically. For this device to work properly the wire profile shape must be formed extremely accurately and not deform over time. A further liability of this approach is that the heddle body remains in place and cannot be removed.

U.S. Pat. No. 4,334,555 to Carolyn S. Hoagland (Jun. 15, 1982) describes a non-removable wire heddle with a very novel eyelet configuration that allows removal or installation of a warp element without threading the warp element through the eyelet. It is clear that the warp element requires considerable manipulation to remove it from the tightly circumscribing wire restraint that is configured like a spring whose end has been cut off and the warp element occupies the second or third turn from the end of the spring. This heddle is clever but does not relate to my patent since it is not removable from the frame of the loom shaft and is not a monolithic entity.

U.S. Pat. No. 5,005,608 to Anderson (Apr. 9, 1991) describes a four piece heddle; two end cables and two plates with aligned apertures to form the eyelet hole for the warp. Each plate extends only half of the full length of the functional profile of the heddle. An eyelet is formed at one end of a plate by a slotted aperture and a dimpled groove in the end of the opposing plate. To install the warp the plate with two slotted apertures is rotated about the warp retaining aperture and opened up to allow the insertion of the warp and then it is re-hooked to the lower cable (24). Thus if 400 heddles were to be used in a pattern on a loom there would be 1600 individual parts to comprise the 400 functional elements. This does not seem too practical.

U.S. Pat. No. 4,790,357 to Kramer et al. (Aug. 6, 1987) This patent deals primarily with the characteristics of a reduced mass heddle frame to reduce the dynamic loads imposed on the attending moving mechanism. It does show a removable heddle that appears to snap into the frame of the heddle holder. The warp has to be threaded in the conventional manner and is not separable from the heddle once it is installed. Thus it appears to have few advantages over a conventional steel heddle that is currently available. It does not relate to the patent of this application.

SUMMARY

The invention, a simple removable heddle comprised of a single monolithic body and a mating insertion tool are the subject of this patent. The heddle can be installed or removed at any time during the weaving process and it allows insertion or removal of the warp element after the heddle has been inserted in the loom shaft frame. The heddle and insertion tool have been reduced to practice in October, 2003 and both have functioned flawlessly in a novel horizontal four shaft loom with a wool warp set at 12 dents per inch weaving a 21 inch width (252 heddles) pattern.

DRAWINGS—FIGS

FIG. 3A shows a cross section through the slot in the end of the insertion tool when installed on the heddle.

FIG. 3B shows a cross section of the tool resting on top of the heddle.

FIG. 3C shows a cross section of the tool dropping into the slot of the heddle to prevent lateral motion of the heddle.

FIG. 3D shows the tool modified rectangular section to prevent rotation relative to the heddle.

FIG. 3E shows the retaining lip on the handle to prevent the rear of the heddle moving laterally.

DRAWINGS—REFERENCE NUMERALS

10 Main heddle body
10-A Upper tapered beam.
10-B Lower tapered beam
10-C Upper tapered beam chamfer.
10-D Lower tapered beam chamfer.
10-E Heddle retaining slot.
10-F Installation tool retaining slot.
10-G Hole to aid extraction of heddle from loom shaft.
10-H Opposing side of 10 to show aperture shape for molding 10-B and 10-D.
10-L Lead-in taper to aid installation
10-M Retaining radius #1.
10-N Retaining radius #2
10-P Warp slot
14 Loom shaft configuration and elements to accommodate heddle.
14-A Heddle retaining rod #1
14-B Heddle retaining rod #2
14-C Shaft transverse tube
14-D Retaining rod spacing and support elements.
14-E Opposing transverse shaft heddle support.
18 Warp thread (installed in heddle).
18-A Warp thread prior to installation in heddle.
22 Installation tool
22-A Handle
22-B Protruding lip from 22A to retain heddle (10).
22-C Rectangular section to fit in heddle slot (10F).
22-D Notched section of 22 to prevent lateral deflection of heddle (10).
22-E Horizontal flat cut of 22 to limit in-plane deflection of heddle (10).
22-F Slot in 22 to limit out-of plane deflection of heddle (10).

DESCRIPTION OF THE PREFERRED EMBODIMENTS

FIGS. 1 through 4 illustrate the main features of the heddle and the insertion tool. A principal requirement of the heddle design is to be able to install it axially parallel to the principal axis of the installed heddle without having any feature of the heddle catching on any warp element during the installation process. The mating tool (22) facilitates this process.

Figure 1:
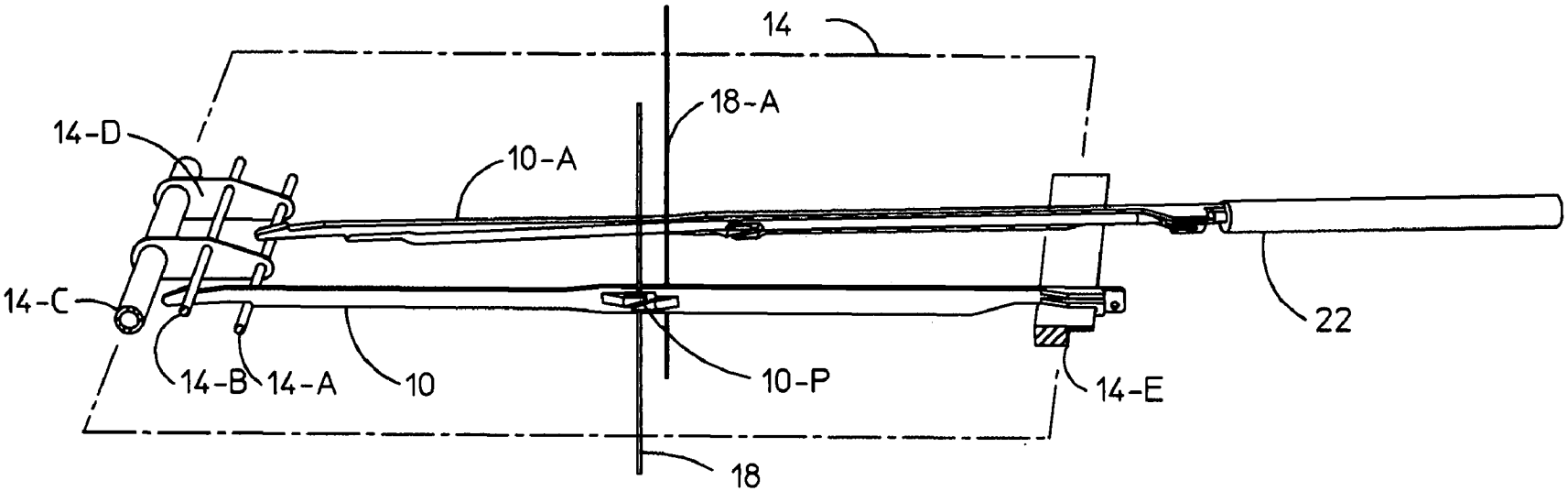
FIG. 1 shows a heddle installed in a representative loom shaft frame with the warp going through the eyelet portion and a second heddle shown in a partially installed position prior to securing the warp element.
Figures 2, 2A, 2B, 2C, 2D:
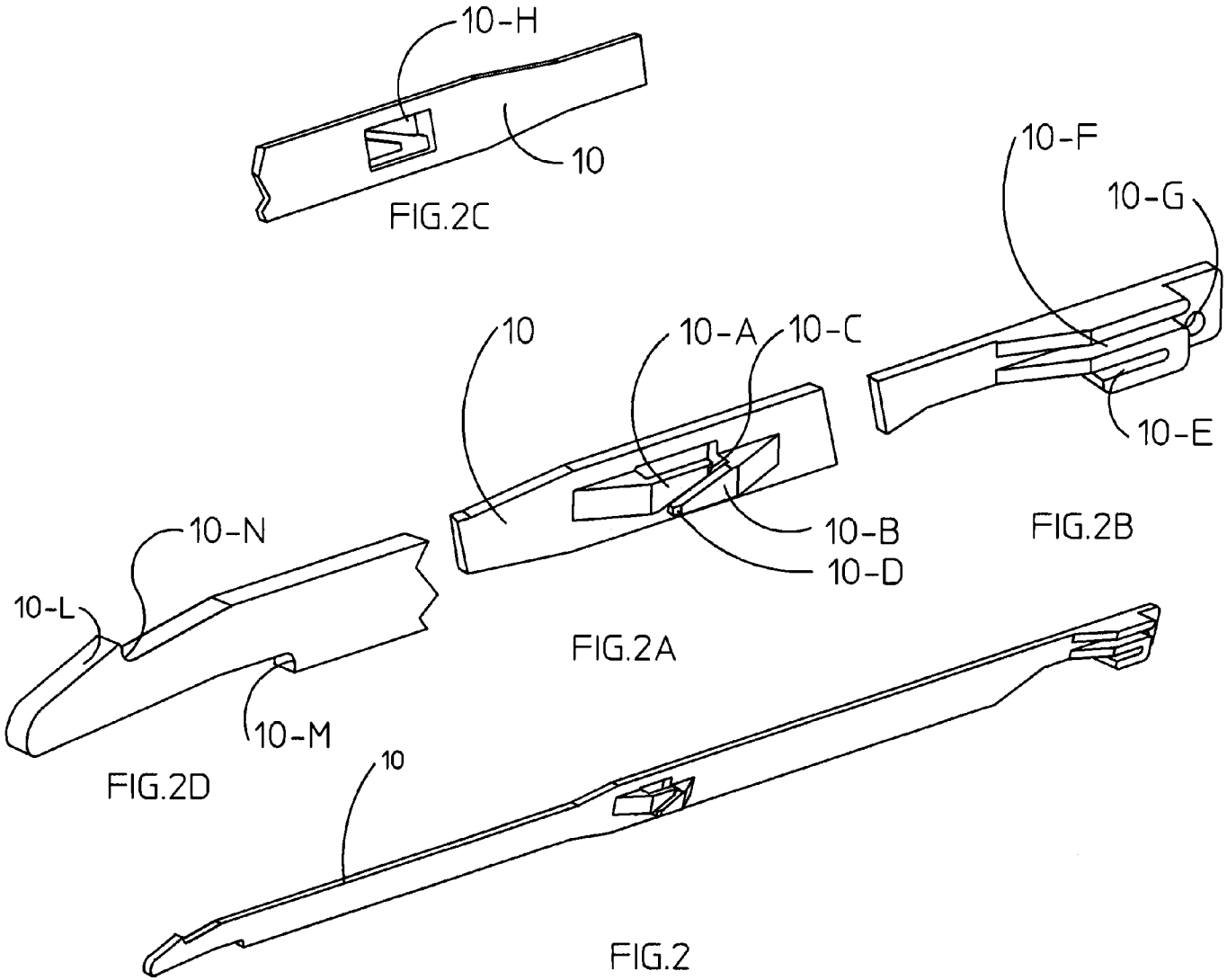
FIGS. 2 through 2D show the heddle and principle features of the heddle.
Figure 3:
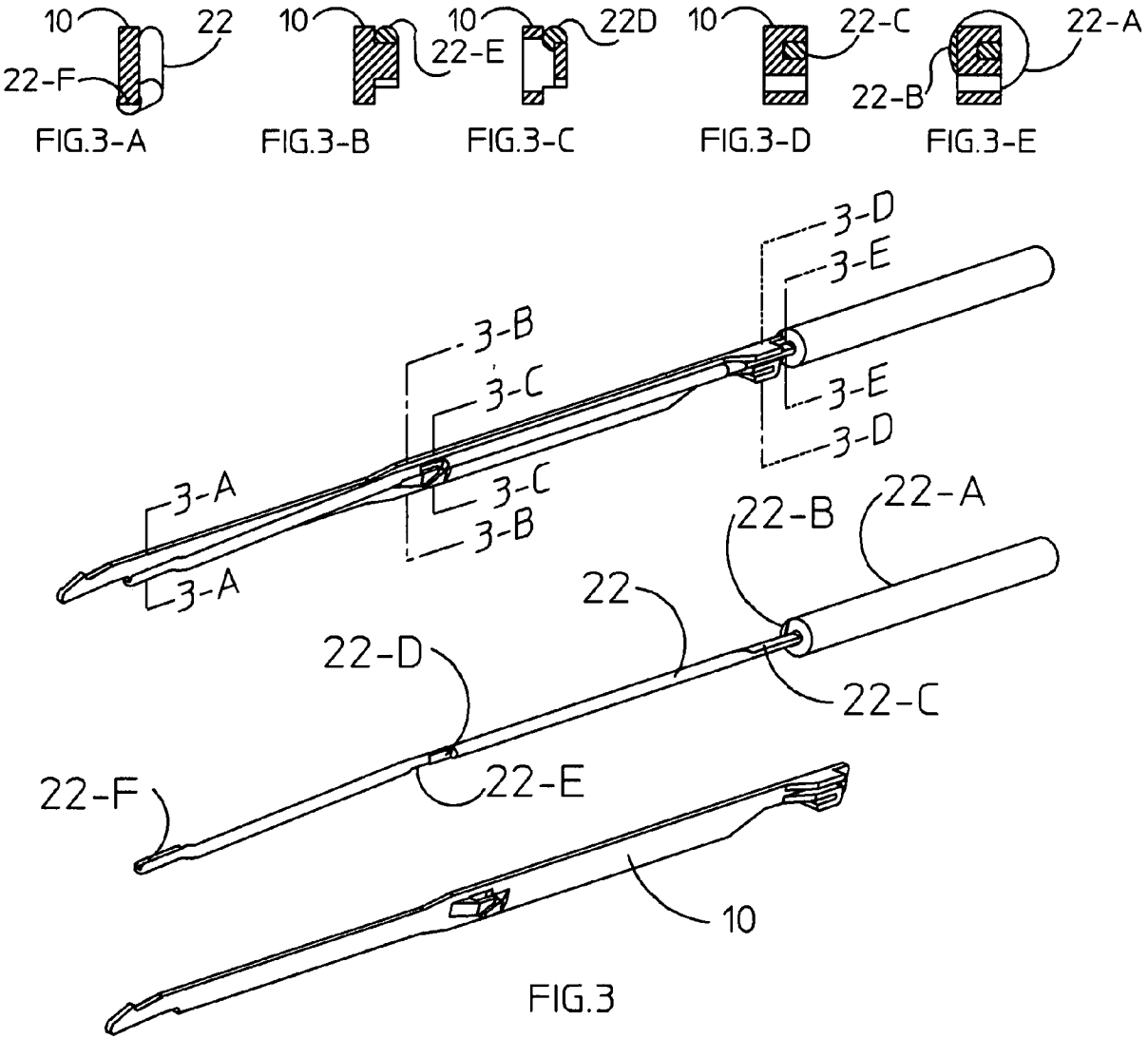
FIG. 3 shows the heddle, insertion tool, and coupled heddle and insertion tool.

FIG. 1 illustrates a hypothetical frame for a loom shaft (14) that will support the heddle. The shaft support that is first encountered (14-E) during the installation process has to be thin and rectangular and displaced slightly to allow the heddle to be inserted without disturbing installed heddles on adjacent shafts. The support on the other end (14-C) has to be torsionally rigid and hence a tube configuration is shown. Intermediate supports (14-D) are spaced periodically to support rods (14-A) and (14-B) to the frame (14).

There are four critical features of the heddle;

1.) When installed, the far end of the heddle has two displaced radii (10-M) and (10-N) that engage two orthogonal round rods (14-A and 14-B). on the shaft frame (14). As the heddle is pushed into place the end of the heddle rides over the first encountered shaft rod (14-A) and under the second encountered shaft rod (14-B). The ability to go under the second shaft is enhanced by a lead-in taper (10-L) on the heddle. As the heddle is further pushed into place it is slightly bent in—plane resulting in a strong snapping motion as the heddle conforms to the radii of the two shaft rods (14A and 14-B). This retention force captures the heddle axially relative to the shaft. The material properties of the heddle plastic must be dimensionally stable enough to preserve these physical characteristic's in all expected environments. Polycarbonate plastics were used with great success in the original prototypes.

2.) The central eyelet portion is formed by an aperture (10-H) between upper and lower extensions of the main beam member. Tangent to the near and far edges of the aperture (10-H) there are two small cantilevered tapered beam members (10-A and 10-B) that overlap each other with a small angled slot (10-P) separating the two tapered beam members such that the warp (18) can be inserted in the slot (10-P).

3.) The angle of the slot relative to the principal axis of the heddle must be such that the planar surface parallel to the face of (10) of one beam member (10-A) overlaps the parallel planar surface of the opposing beam member (10-B) at all times.

4.) The ends of the tapered beam members must be chamfered slightly (10-C and 10-D) such that the planar surface of the opposing beam prevents the adjacent warp elements from catching on the tip of the beam as the shed is formed. In other words, the adjacent warp elements from other shafts must ride over the two tapered beams in a manner such that they appear to the warp elements (18-A) as a single uninterrupted continuous beam.

During installation the near end of the heddle has an open ended short slot (10-E) that engages a lip on the shaft (14-E). This slot has the same width as the width of the central eyelet feature and serves to keep the heddle from rotating about its principal axis when in operation. Slightly above this slot is another slot (10-F that accommodates the insertion tool (22). The heddle has a small circular hole (10-G) where a small "U" shaped tool can be used to extract the heddle from the loom.

The insertion tool has been configured to eliminate lateral buckling of the heddle and to provide an extra long appendage to allow alignment of the heddle during installation. There are several features in this tool that are important to the invention.

1.) The handle (22-A) has a protruding lip (22-B) that captures the rear of the heddle between the tool (22) and the lip (22-B) so that the heddle cannot translate laterally relative to the tool (22). The lip is open-ended so that when the tool is retracted it falls freely from the heddle (10).

2.) The tool (22) has several cutouts in the otherwise circular profile of the rod. The first cutout (22-C) fits into the heddle slot (10-F) and serves to keep the toll (22) from rotating relative to the heddle (10).

3.) A further cutout (22-D), which is orthogonal to (22-C), is provided to form a lip that drops down into the gap formed by the tapered upper beam of the heddle (10-A) and the main portion of the heddle (10) body. This captures the heddle (10) laterally relative to the tool (22).

4.) Another cutout (22-E) which is orthogonal to cutout (22-C) provides a shelf for the heddle to rest on the top of the tapered beam (10-A). This prevents vertical displacement of the tool (22) relative to the heddle (10) in one direction.

5.) The final cutout is a slot (22-F) in the tip of the tool (22). This prevents vertical displacement of the tool relative to the heddle in a direction opposite to the cutout provided by (22-E).

6.) Cutouts (22-C, 22-E, and 22-F) restrain the heddle (10) in a vertical direction. Their vertical relationship is such that the heddle (10) must be bent slightly at cutout (22-E) in a direction opposite to cutouts (22-C and 22-F) which results in a slight snapping into place of the heddle to achieve vertical retention.

7.) Cutouts (22-D and the sides of 22-F) along with the lip (22-B) provide lateral restraint to prevent buckling.

8.) When the tool is to be removed it simply is pulled out slightly; the tool is then free to rotate about its principal axis and falls free of the heddle. This action occurs principally at (22-C) when the lip (22-B) disengages from the heddle (10).

OPERATION OF INVENTION

The operation of the invention is very simple. The heddle (10) is first inserted between the lip (22-B) and the main body of the tool (22) and then rotated about the restrained face engaging the lip (22-B) on the handle (22-A) until the heddle slot (10-F) slides into cutout (22-C). Now the tool (22) and the heddle (10) are adjacent and cutout (22-D) is inserted in the heddle (10). This automatically aligns cutout (22-E) to the heddle (10). Now the heddle is slightly bent to put the tip of the heddle (10) into the slot (22-F).

The tool (22) and attached heddle (10) are now pushed straight into the shaft frame (14) until a strong snapping action is felt in the handle (22-A). The tool is then pulled straight out in the opposite direction for removal.

Figure 4:
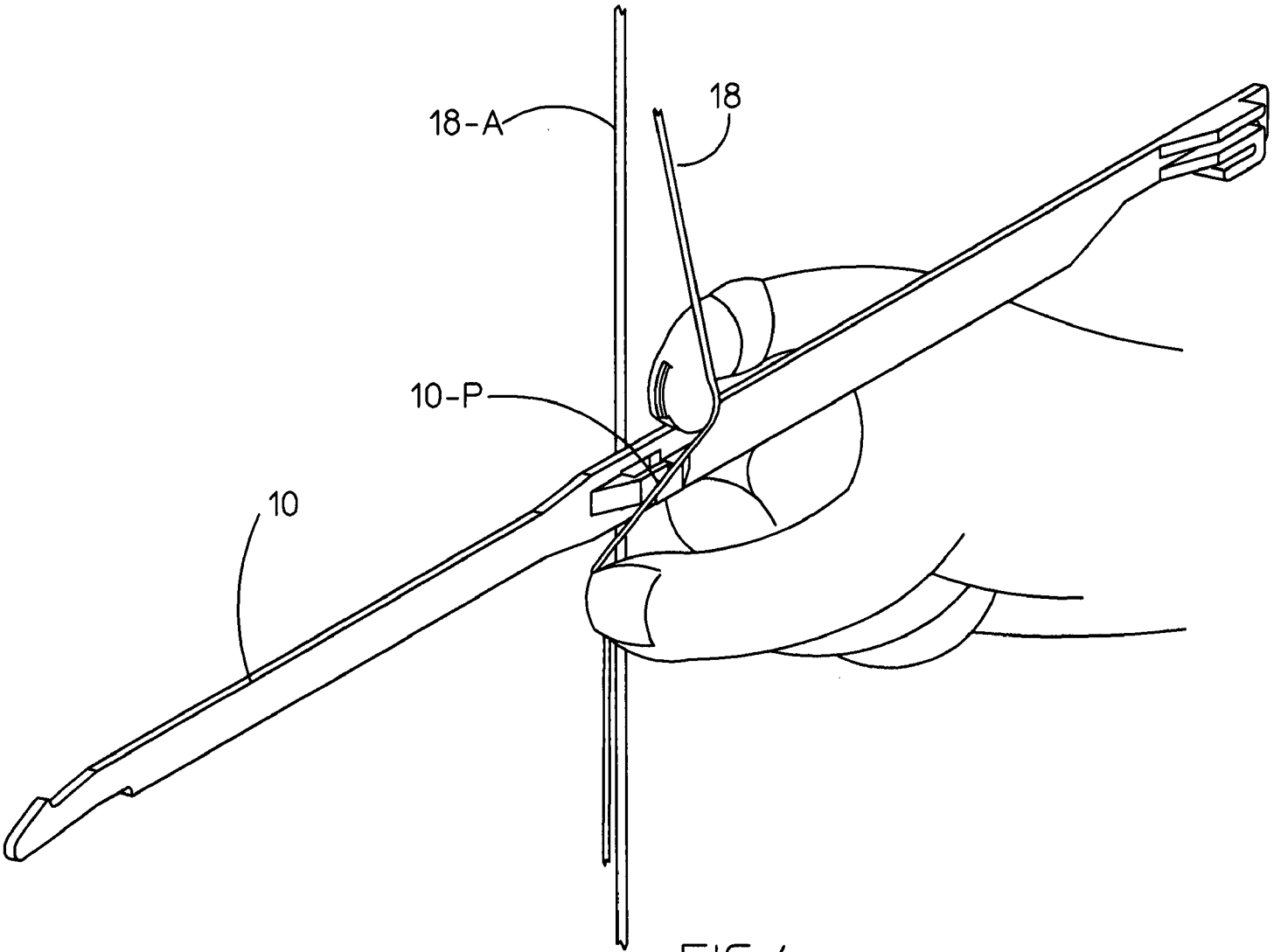
FIG. 4 shows how the hand (or other device) bends the warp element to slide into the open heddle slot between the two tapered beams.

The warp (18) is then bent at an angle as shown in FIG. 4 with the fingers or other tool and displaced laterally into the heddle slot (10-P). When the warp (18) is released it is captured in the eyelet portion of the heddle (10) and cannot get out during the shed formation of the weaving process. The shaft (14) is not shown for clarity.

CONCLUSIONS, RAMIFICATIONS, AND SCOPE OF INVENTION

In conclusion, no heddle previously developed, as far as I can tell, has the simplicity of manufacturing and the features of the heddle described in this patent application. As previously discussed, prior removable heddles had multiple separate parts that had to be assembled in place on the loom. Almost all had to have lateral access to be assembled and that is not easy when there are adjacent warp members. As the number of shafts on newer looms increases from the low end (4), to the high end (16 and up), the number of heddles increases dramatically and so does the concern about making mistakes. This invention solves some of those problems such as threading on the wrong shafts. The ease of installation is such that any beginning weaver can install and remove the heddle intuitively. In addition, shaft switching to obtain different patterns forming a contiguous pattern is now feasible.

I claim:

1. A weaving heddle constructed as a single monolithic body, capable of being installed and removed in a loom by axial motion parallel to the principal axis of the heddle, and comprised of:

(a) two end features for engaging a means for a heddle supporting frame, said features providing controlled restraint of axial, rotational, and one orthogonal motion of the monolithic body relative to it's principal long axis, and (b) said controlled restraint provided by the shape of the end features as they interface with the supporting frame, and the allowable bending properties of the monolithic body during and after installation, and (c) a central feature that allows the installation and removal of an untensioned warp element by lateral motion through an inclined slot in the exterior wall of a rectangular shaped constraining enclosure, said constraint acting orthogonal to the tensioned warp element after installation.

2. The heddle of claim 1 wherein said central feature comprising two offset cantilever tapered beams, with the tips of said cantilever beams displaced laterally with respect to the principle axis of the heddle, and in proximity to each others base, and with each base supported at the base of the said wedge-shaped projections, and, (a) said tapered beams are not as wide as the base of said wedge-shaped projections, thus forming a rectangular constraining enclosure when viewed from an axis parallel to the principal face and orthogonal to the long axis of the heddle, and, (b) said tapered beams having external tapered faces, located at the maximum projection of said wedge-shaped elements, are coplanar and parallel to the said principal axial face of the heddle and faces orthogonal to said external faces that are inclined, parallel, and facing each other, thus forming a slot for the acceptance or removal of a warp element, and, (d) the tips of said cantilevered tapered beams have a chamfer whose slope is toward the principal face of the heddle and away from said external coplanar surfaces to prevent snagging of adjacent external warp elements during the shed formation process.

3. A heddle of claim 2 comprising means for accepting an installation tool that has its own special features such that the heddle and the installation tool form a matched functional pair, and (a) the installation tool comprising means for preventing lateral buckling of the heddle during the installation process of the heddle, and, (b) the installation tool comprising an extended handle to facilitate alignment of the heddle during the installation process, and, (c) means for adjustments as the tool is extracted from the heddle and the heddle supporting frame.

* * * * *